United States Patent [19]

Clayton

[11] Patent Number: 4,539,237

[45] Date of Patent: Sep. 3, 1985

[54] FASTENING APPARATUS FOR TWIST TIES

[75] Inventor: William J. Clayton, Fairport, N.Y.

[73] Assignee: Mobil Oil Corporation, New York, N.Y.

[21] Appl. No.: 512,503

[22] Filed: Jul. 11, 1983

[51] Int. Cl.[3] ..... B32B 3/28

[52] U.S. Cl. ..... 428/40; 24/30.5 R; 428/43; 428/174; 428/187; 428/189

[58] Field of Search ..... 428/40, 43, 136, 155, 428/189, 174; 24/30.5 R, 30.5 W, 30.5 P, 30.5 T, 16 PB

[56] References Cited

U.S. PATENT DOCUMENTS

| | | | |
|---|---|---|---|
| 2,144,263 | 1/1939 | Lane | 93/1 |
| 2,173,972 | 9/1939 | Lane | 24/67 |
| 2,173,989 | 9/1939 | Wilbur | 24/17 |
| 2,338,749 | 1/1944 | Wilbur | 24/67 |
| 3,147,522 | 9/1964 | Schumm | 24/30.5 T |
| 3,261,126 | 7/1966 | Marks | 428/40 |
| 3,311,288 | 3/1967 | Lemelson | 24/30.5 T |
| 3,417,863 | 12/1968 | Paxton | 24/30.5 T |

*Primary Examiner*—Paul J. Thibodeau

*Attorney, Agent, or Firm*—Alexander J. McKillop; Michael G. Gilman; Charles J. Speciale

[57] ABSTRACT

Disclosed is a fastening apparatus for fastening a gang of edge-connected but separable twist ties to a surface. The apparatus includes a material having a first adhesive coated portion secured to the gang of ties and a second adhesive coated portion for securing the gang of ties to the surface. A releasable protective cover covers at least the second adhesive coated portion.

11 Claims, 7 Drawing Figures

FASTENING APPARATUS FOR TWIST TIES

BACKGROUND OF THE INVENTION

1. Field of the Invention

The present invention relates to twist ties typically used for closing plastic bags and, more particularly, to an arrangement whereby a plurality of severable, but interconnected, twist ties can be easily fastened by means of an adhesive strip to a holding surface convenient to a user.

2. Discussion of the Prior Art

Twist ties are commonly used for many purposes, one of which is to seal closed the open end of a plastic bag. Typically, a plurality of severable but interconnected twist ties are packaged for sale with plastic bags of various types. Unfortunately, consumers often lose or misplace the twist ties so that when a tie is needed to close a bag it is difficult to find.

SUMMARY OF THE INVENTION

The present invention has been designed to remedy the problem of lost or misplaced twist ties. Accordingly, an object of the invention is the provision of a fastening arrangement whereby a plurality of interconnected twist ties can be easily fastened by means of an adhesive strip to a convenient holding surface, such as the back side of a cupboard door, to prevent their being lost or misplaced, while still permitting individual ties to be severed without disturbing the fastening arrangement.

an additional object of the invention is the provision of a fastening arrangement as described above which is easily and conveniently used by a consumer.

The above objects and others are achieved through the use of an adhesive-backed material which is connected to a conventional gang of severable but interconnected twist ties, the material including a portion thereof which contains an adhesive strip and which is available for fastening to a desired surface. The adhesive-backed material holds the gang of twist ties to a desired surface location, yet permits the severance of individual twist ties without causing a release of the material from the surface to which it is adhered. The portion of the material available for fastening is desirably protected by an adhered covering prior to its being placed in use.

The above objects, structural features and advantages of the invention will be more clearly understood from the following detailed description of the invention, which is provided in connection with the accompanying drawings.

DETAILED DESCRIPTION OF THE INVENTION

Figure 1:
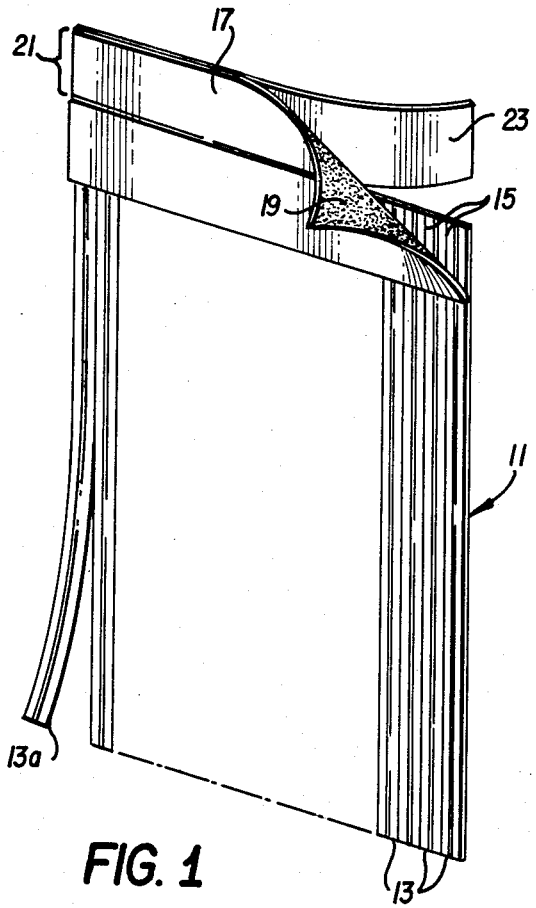
FIG. 1 is a perspective view of a first embodiment of the invention.

A first embodiment of the invention is shown in FIG. 1. A conventional gang 11 of individual twist ties 13 is shown, with the ties arranged vertically. As well known, the individual twist ties 13 are edge connected along perforated lines 15, which permit ready separation of ties 13, one from another. A backing material 17, having an adhesive coated surface 19, is connected along one end of the gang 11 of ties and to each individual tie 13. The upper portion of backing material 17 extends beyond the end of the gang of ties to form a fastening area 21, in the form of an adhesive strip, which can be fastened to any user-convenient surface, such as the front or back side of the door of a kitchen cupboard. A protective covering material 23 is placed over the adhesive of the fastening area 21 during shipping to protect the adhesive coated surface 19. The backing material 17 may be a thin layer of paper or plastics to which the adhesive layer is applied.

Figure 2:
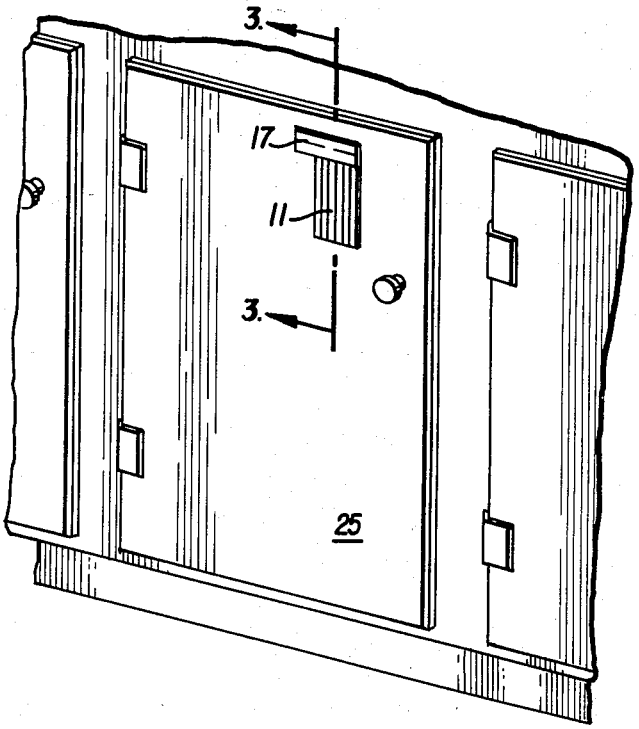
FIG. 2 illustrates one use of the FIG. 1 embodiment.
Figure 3:
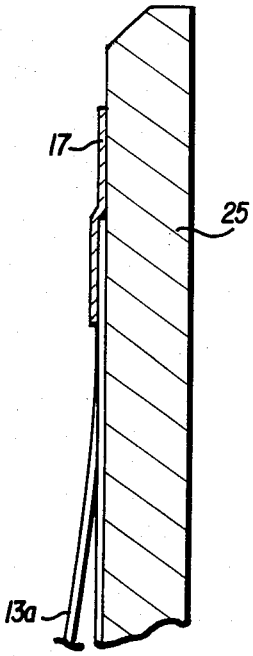
FIG. 3 is a sectional view along the line 3—3 in FIG. 2.

In use, a consumer removes the protective covering material 23 and process the adhesive strip of the fastening area 21 to a desired convenient surface, such as a cupboard door 25, as shown in FIGS. 2 and 3. The gang 11 of ties is now firmly secured to a desired surface. When an individual tie 13*a* is needed, the user conveniently removes it from the edge of gang 11 by peeling it off, as shown in FIGS. 1 and 3.

Figure 4:
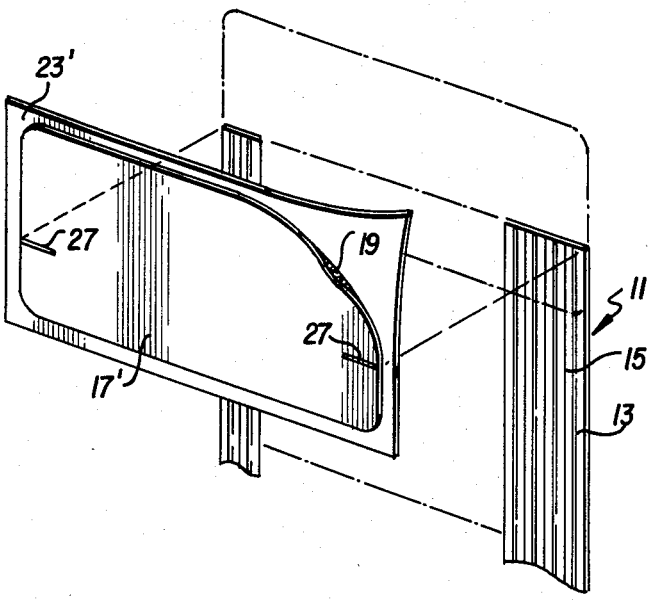
FIG. 4 is a perspective view of a second embodiment of the invention.

FIG. 4 illustrates a modified embodiment of the invention, wherein like structures have the same reference numbers as in FIGS. 1–3, and modified structures are indicated by prime symbols. In this embodiment, the backing material 17' is packaged and shipped with the gang of ties 11, but is not fastened thereto. The backing material 17' includes an adhesive coated surface 19, which is covered in its entirety by a protective covering material 23'. Visual indicator lines 27 are provided adjacent opposite vertical edges of an exposed side of backing material 17'.

With this embodiment, a consumer first removes the protective covering material 23', thereafter visually aligns the indicator lines 27 with the top edge of the gang of ties 11. He then presses that portion of backing 17' below indicator areas 27 onto the surface of the gang of ties 11, thereby leaving an exposed upper portion of adhesive surface 19 which is pressed onto a desired surface location, such as the cupboard shown in FIGS. 2 and 3. The removal of individual ties 13 from the gang then occurs exactly as described above with respect to FIGS. 1–3.

Figure 5:
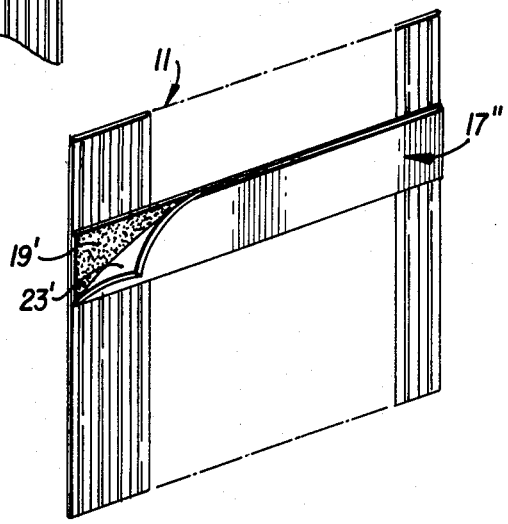
FIG. 5 is a perspective view of a third embodiment falling within the scope of the invention.

FIG. 5 illustrates another embodiment falling within the scope of the invention. It this embodiment, the backing material 17'' is formed as a narrow strip having an adhesive coating on opposite surfaces. One adhesive coated surface is in engagement with a surface of the gang of ties 11, while the other is protected by protective covering layer 23'. As shown, the backing material strip 17'' does not extend beyond the perimeter of the gang of ties 11. In use, a consumer removes protective covering layer 23' and then presses the exposed adhesive strip against a desired fastening surface, in the same manner as described above with respect to previous embodiments.

Figure 6:
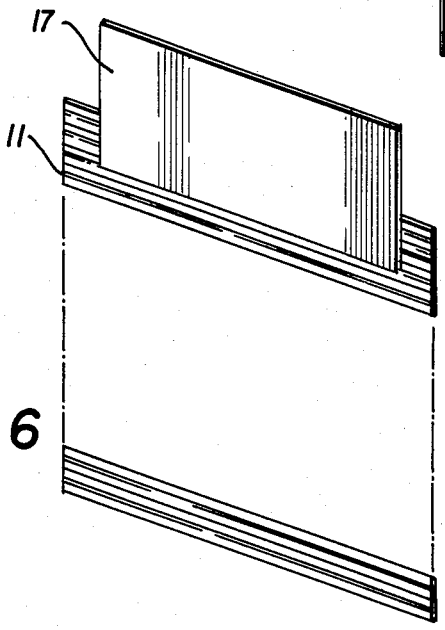
FIG. 6 is a perspective view of a fourth embodiment of the invention.

FIG. 6 illustrates another embodiment of the invention which is similar to that shown in FIG. 1, except the ties 13 of gang of ties 11 are arranged horizontally instead of vertically.

As evident from the above, the invention allows a consumer to securely fasten a gang of twist ties to a convenient surface to prevent its loss or misplacement, while still permitting easily individual severing of the ties when required.

Figure 7:
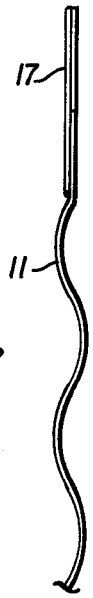
FIG. 7 is a side view of a modification of the FIG. 1 embodiment.

The gang of ties 11 can be conveniently formed into a waved profile, a illustrated in FIG. 7, to provide it with a unique appearance and to make it easier to separate and remove the ties. The undulating waves extend in the same direction as the longitudinal extent of the ties in the gang. If a waved profile is employed, the top of the gang should be straight for 1 to 2 inches to facilitate application of the backing material 17 thereto and the pressing of the assembly onto a desired surface.

While several alternative embodiments of the invention have been described and illustrated, it should be apparent that many modifications can be made thereto within the spirit and scope of the invention. Accordingly, the invention is not limited by the foregoing description, but is only limited by the scope of the claims appended hereto.

I claim:

1. A twist tie system whereby a plurality of edgeconnected, separable twist ties forming a gang of twist ties can be fastened to a surface, said system comprising:

a material fastened at a first portion thereof to a surface of said gang of twist ties, said material having a second portion which is covered with an adhesive and which is exposable to permit fastening of said material and gang of twist ties to a surface by means of said adhesive covered second portion.

2. A system as in claim 1, wherein said material is fastened to said gang of twist ties by an adhesive.

3. A system as in claim 1, wherein the adhesive covering of said second portion is covered by a removable protective material adhered thereto.

4. A system as in claim 1, wherein at least a portion of said gang of ties, spaced from said material, is formed in a waved profile, the undulations of said waves extending in the same direction as the longitudinal extent of the ties in said gang of ties.

5. A twist system whereby a plurality of edge-connected separable twist ties forming a gang of twist ties can be fastened to a surface, said system comprising:

a plurality of edge-connected, separable twist ties forming a gang of ties; and an adhesive strip having a first portion thereof for fastening to said gang of ties, said strip having indicators thereon indicating where said adhesive strip should be positioned over said gang of ties so that a second portion thereof extends beyond said gang of ties for use in fastening said gang of ties to a surface.

6. A system in claim 5, wherein said indicators are index lines on opposite lateral sides of one surface of said adhesive strip.

7. A system as in claim 1, wherein said extending second portion of said adhesive strip is covered by a removable protective material adhered thereto.

8. A twist tie system whereby a plurality of edgeconnected, separable twist ties forming a gang of twist ties can be fastened to a surface, said system comprising:

a material fastened at a first portion thereof to a surface of said gang of twist ties, said material having a second portion which is covered with an adhesive and which is exposable to permit fastening of said material and gang of twist ties to a surface by means of said adhesive covered second portion, said material having said first and second portions on a same surface thereof, said material extending beyond said gang of twist ties to form said second portion.

9. A system as in claim 8, wherein said material is fastened to said gang of twist ties by an adhesive.

10. A system as in claim 8, wherein the adhesive covering of said second portion is covered by a removable protective material adhered thereto.

11. A system as in claim 8, wherein at least a portion of said gang of ties, spaced from said material, is formed in a waved profile, the undulations of said waves extending in the same direction as the longitudinal extent of the ties in said gang of ties.

* * * * *